US006616271B2

(12) United States Patent
Silverbrook

(10) Patent No.: US 6,616,271 B2
(45) **Date of Patent: *Sep. 9, 2003**

(54) ADHESIVE-BASED INK JET PRINT HEAD ASSEMBLY

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/942,549

(22) Filed: Aug. 31, 2001

(65) Prior Publication Data

US 2002/0033867 A1 Mar. 21, 2002

Related U.S. Application Data

(63) Continuation-in-part of application No. 09/425,421, filed on Oct. 19, 1999, now Pat. No. 6,312,114.

(51) Int. Cl.[7] ..... B41J 2/175
(52) U.S. Cl. ..... 347/85
(58) Field of Search ..... 347/85, 86, 87, 347/50, 42, 40, 13

(56) References Cited

U.S. PATENT DOCUMENTS

| | | | | |
|---|---|---|---|---|
| 4,554,558 A | | 11/1985 | Beaudet et al. | |
| 4,812,859 A | | 3/1989 | Chan et al. | |
| 5,841,452 A | * | 11/1998 | Silverbrook | 347/47 |
| 5,976,191 A | * | 11/1999 | Phillips | 623/55 |
| 6,190,002 B1 | * | 2/2001 | Spivey | 347/50 |
| 6,257,703 B1 | * | 7/2001 | Hirosawa et al. | 347/50 |
| 6,312,114 B1 | * | 11/2001 | Silverbrook | 347/85 |
| 6,318,849 B1 | * | 11/2001 | Silverbrook | 347/85 |
| 6,457,810 B1 | * | 10/2002 | King et al. | 347/49 |
| 6,485,135 B1 | * | 11/2002 | Foote et al. | 347/84 |
| 2002/0003556 A1 | * | 1/2002 | Mori | 347/50 |

FOREIGN PATENT DOCUMENTS

| | | |
|---|---|---|
| DE | 19612760 A1 | 10/1997 |
| EP | 0822081 A2 | 2/1998 |

* cited by examiner

*Primary Examiner*—Michael Nghiem

(57) ABSTRACT

An ink jet print head assembly includes at least one elongate ink jet print head chip that is the product of an integrated circuit fabrication technique. The assembly also includes at least one corresponding ink jet print head chip carrier that defines an elongate recess having a pair of opposed side walls. The, or each, print head chip is received in one respective recess. The, or each, ink jet print head chip and said respective recess are dimensioned so that a gap is defined between the, or each, ink jet print head chip and each side wall. Resiliently deformable material is positioned in each gap to retain the, or each, print head chip in position in said respective recess.

7 Claims, 7 Drawing Sheets

ADHESIVE-BASED INK JET PRINT HEAD ASSEMBLY

RELATED AND INCORPORATED PATENTS AND PATENT APPLICATIONS

This application is a continuation in part application of U.S. patent application Ser. No. 09/425,421, filed Oct. 19, 1999, now U.S. Pat. No. 6,312,114. U.S. patent application Ser. No. 09/425,421 now U.S. Pat. No. 6,312,114, Ser. Nos. 09/693,644, 09/693,737, now U.S. Pat. No. 6,457,870, Ser. No. 09/693,340 now U.S. Pat. No. 6,485,135, and Ser. No. 09/608,779 now abandoned are hereby incorporated by reference.

STATEMENT REGARDING FEDERALLY SPONSORED RESEARCH OR DEVELOPMENT

Not applicable

FIELD OF THE INVENTION

This invention relates to a print head assembly. More particularly, this invention relates to a print head assembly and to a method of assembling a print head.

BACKGROUND OF THE INVENTION

The Applicant has developed a page width ink jet print head that is the subject of a large number of United States patents and patent applications. The print head is capable of printing text and images having resolutions as high as 1600 dpi.

An integral part of the print head is one or more print head chips. The print head chips are the product of an integrated circuit fabrication technique. In particular, each print head chip comprises a plurality of nozzle arrangements that are positioned along a length of silicon wafer substrate. Each nozzle arrangement is in the form of a micro electro-mechanical system. The applicant has developed technology that allows for the fabrication of such print heads having up to 84,000 nozzle arrangements.

In general, during assembly of a print head, the print head chips are positioned in some form of carrier. The carrier forms part of an ink distribution arrangement such as an ink distribution manifold. Instead, the carrier can itself be attached in some way to an ink distribution arrangement to define some form of interface between the print head chips and the ink distribution arrangement.

The positioning of the print head chips in their respective carriers usually takes place by way of simply urging the print head chip into a recess defined in the carrier. The recess is thus dimensioned so that the fit is a snug fit or an interference fit to ensure that the print head chip is retained in position in the carrier.

Due to the elongate nature of the print head chip, the print head chip is susceptible to flexure. As a result, any stresses that are exerted on the carrier during normal handling and operation can result in flexure of the carrier and thus the print head chip. It will be appreciated by those of ordinary skill in the art that the fact that the nozzle arrangements are each in the form of a micro electro-mechanical system makes such flexure highly undesirable.

A particular problem with such a fit stems from the possible ingress of particulate matter into the recess. This is especially so if the matter is in the form of one or more relatively hard particles. When the chip is urged into the recess, such a particle can become sandwiched between the print head chip and a wall of the recess. This results in a region of stress concentration at that point on the print head chip that is impinged upon by the particle. Thus, when the chip is subjected to a small amount of flexure that would usually not cause a problem, the stress concentration can cause a fracturing of the print head chip.

The Applicant has conceived the present invention to address this problem and to alleviate the necessity for the print head manufacturer to achieve a particulate free environment for the assembly stage of the print head. As is well known, chip manufacturers incur substantial expense to ensure that chip fabrication environments are kept sterile. Applicant believes that it is desirable that the need for such sterile environments does not extend to the print head assembly stage.

SUMMARY OF THE INVENTION

According to a first aspect of the invention, there is provided an ink jet print head assembly that comprises

- at least one elongate ink jet print head chip that is the product of an integrated circuit fabrication technique;
- at least one corresponding ink jet print head chip carrier that defines an elongate recess having a pair of opposed side walls, the, or each, print head chip being received in one respective recess, the, or each, ink jet print head chip and said respective recess being dimensioned so that a gap is defined between the, or each, ink jet print head chip and each side wall; and
- resiliently deformable material that is positioned in each gap to retain the, or each, print head chip in position in said respective recess.

According to a second aspect of the invention, there is provided a method of assembling an ink jet print head having at least one elongate ink jet print head chip that is the product of an integrated circuit fabrication technique and at least one corresponding ink jet print head chip carrier that defines an elongate recess having a pair of opposed side walls, the, or each, ink jet print head chip and said respective recess being dimensioned so that a width of said the, or each, print head chip is less than a width of said respective recess to a predetermined extent, the method comprising the steps of:

- positioning the, or each, ink jet print head chip in said respective carrier so that a gap is defined on each side of the ink jet print head chip by said pair of opposed side walls and the ink jet print head chip; and
- at least partially filling each gap with an adhesive that is selected from a group of adhesives that cure into elastically deformable material to fix the, or each, ink jet print head chip in said respective recess.

DETAILED DESCRIPTION OF THE DRAWINGS

Figure 1:
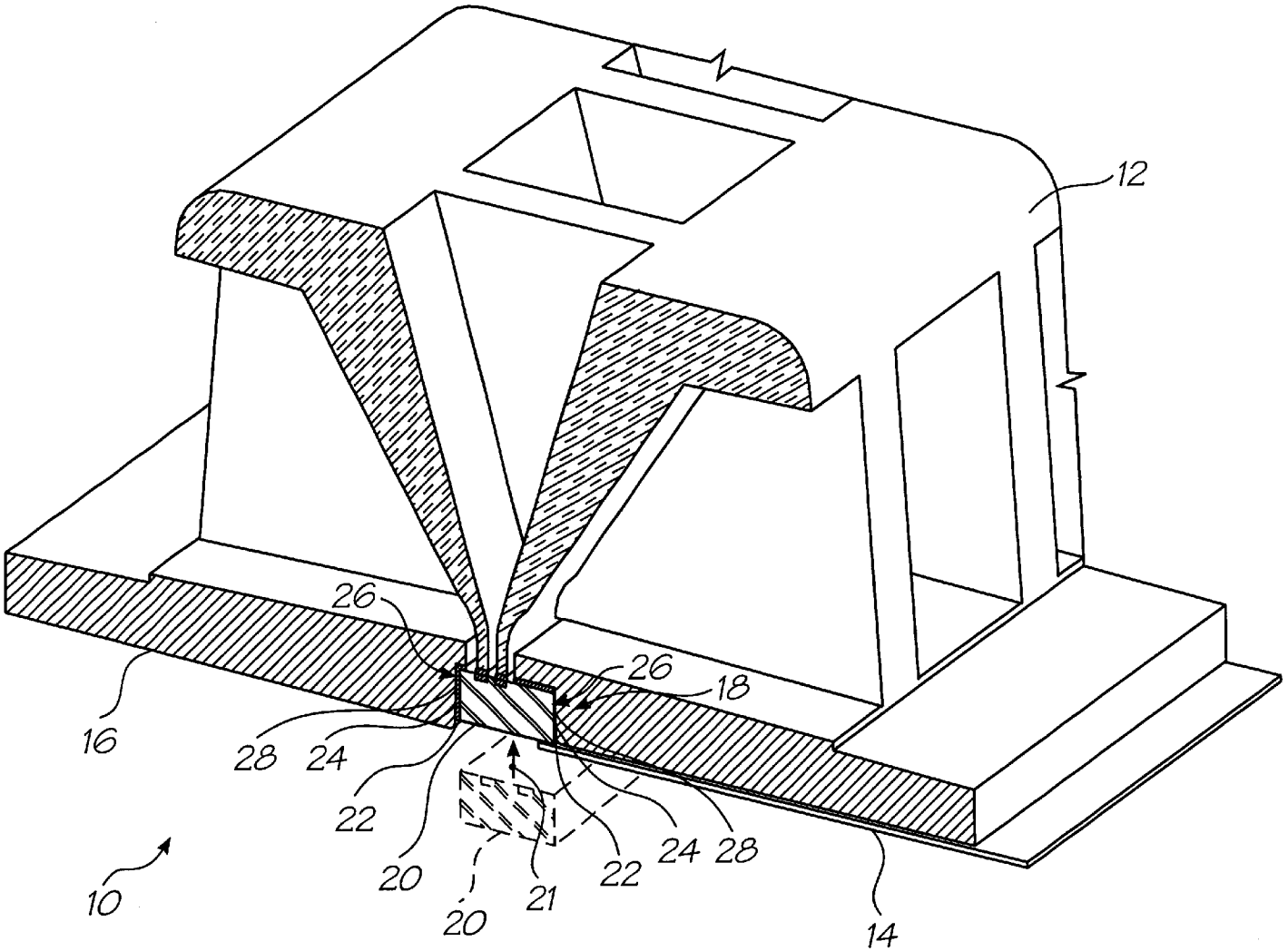
FIG. 1 shows a schematic, three dimensional view of a first embodiment of an ink jet print head assembly, in accordance with the invention.

In FIG. 1, reference numeral 10 generally indicates a first embodiment of an ink jet print head assembly, in accordance with the invention.

The ink jet print head assembly 10 is in the form of a page width ink jet print head.

The ink jet print head assembly 10 includes an ink jet print head chip carrier 14. An ink distribution manifold 12 is positioned on the carrier 14.

The ink jet print head chip carrier 14 includes a support member 16. An elongate recess or channel 18 is defined in the support member 16.

The ink jet print head 10 includes a number of ink jet print head chips, one of which is indicated at 20. The ink jet print head chip 20 is the product of an integrated circuit fabrication technique. Further, the ink jet print head chip 20 comprises a plurality of nozzle arrangements (not shown). Each nozzle arrangement is in the form of a micro electromechanical system. Thus, each nozzle arrangement has at least one moving component that acts on ink within a nozzle chamber to eject that ink from the nozzle chamber.

The ink jet print head chip 20 and the channel 18 both have a rectangular cross section, with the channel 18 being larger than the ink jet print head chip 20, to a predetermined extent. In particular, a width of the channel 18 is larger, to a predetermined extent, than the print head chip 20. A width of the channel 18 can be between approximately 310 microns and 5100 microns. A width of the ink jet print head chip 20 can be between approximately 300 microns and 5000 microns.

During assembly, the chip 20 is inserted into the channel 18 as shown by the arrow 21. The ink jet print head chip 20 is fixed in the channel 18 with an adhesive that, when cured, defines a resiliently flexible material, indicated at 22. As a result of the differing dimensions set out above, when the print head chip 20 is positioned in the channel 18, a gap 26 is set up between each side 24 of the print head chip 20 and a corresponding side wall 28 defining the channel 18. The gap 26 therefore has a width of between approximately 5 and 50 microns. The gaps 26 are filled with the resiliently flexible material 22.

As set out in the above referenced patent applications, the print head chip 20 has an extremely high length to width ratio. The reason for this is that the fabrication process allows the Applicant to conserve chip real estate by keeping the width of the chip 20 as small as possible, while retaining a substantial length to permit page width printing. Furthermore, the carrier 14 and the ink distribution manifold 12 also have relatively high length to width ratios. It follows that the print head 10 is susceptible to flexure during normal handling and operation. It will be appreciated that, without the gap 26, this flexure would be transmitted directly to the print head chip 20, which would be undesirable. In the event that particulate matter contaminated the side 24 of the chip 20 or one of the side walls 28, a point of stress concentration would be set up where the particulate matter impinged on the side wall 28, when the chip 10 was fitted into the channel 18, as has been the practice prior to this invention. Any subsequent flexure of the carrier 14 could then result in a fracturing of the chip 20 at the point of stress concentration.

It follows that the gaps 26 allow for a certain amount of flexure of the carrier 14 without this flexure being transmitted to the chip 20. Further, the adhesive, once cured into the resiliently flexible material 22, serves to accommodate flexure of the carrier 14, while retaining the chip 20 in position in the channel 18.

The adhesive is of the type that cures into an elastomeric material. In particular, the adhesive is a silicon rubber adhesive.

In FIGS. 2 to 9, reference numeral 30 generally indicates a second embodiment of an ink jet print head assembly, in accordance with the invention. With reference to FIG. 1, like reference numerals refer to like parts, unless otherwise specified.

The print head assembly 30 is similar to the print head assembly that is the subject of the above referenced U.S. patent application Ser. Nos. 09/693,644, 09/693,737 now U.S. Pat. No. 6,457,810 and 09/696,340 now U.S. Pat. No. 6,485,135. It follows that this description will be limited to the manner in which the print head chip 20 is mounted and will not set out further detail that is already set out in the above U.S. patent applications, except in a broad fashion.

The print head assembly 30 is a modular print head assembly having a number of modules 32. Each module 32 has a carrier 34 that defines a channel 36 in which the print head chip 20 is received. The relative dimensions of the channel 36 and the print head chip 20 are the same as those of the print head assembly 10. It follows that a gap 38 is also defined between each side 24 of the print head chip 20 and a corresponding side wall 40 of the channel 36. As with the print head assembly 10, the print head chip 10 is fixed in its respective channel 36 with an adhesive that cures into a resiliently flexible material, indicated at 42. The benefits of the gaps 38 and the resiliently flexible material 42 are set out above.

Figure 2:
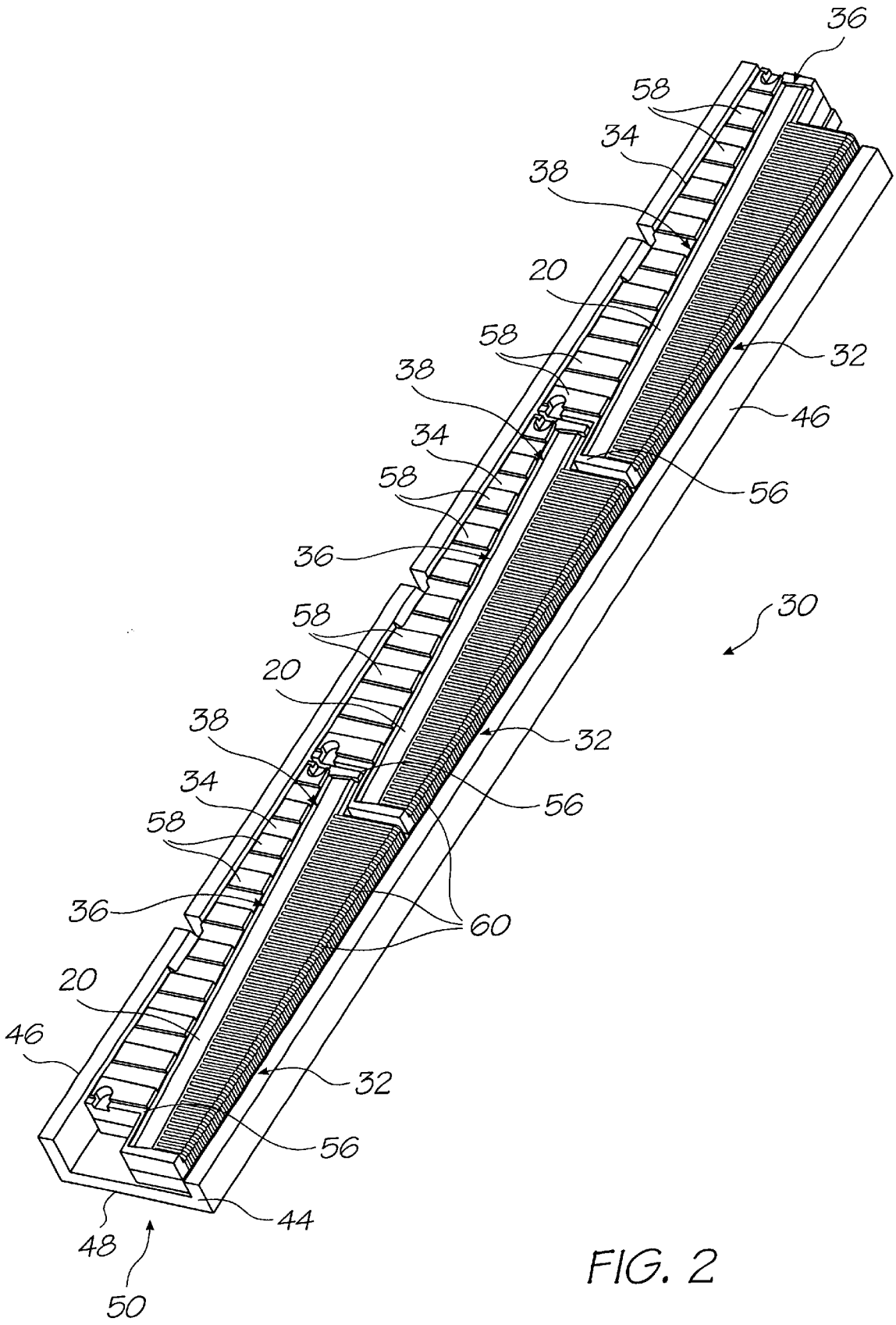
FIG. 2 shows a three dimensional view of a second embodiment of an ink jet print head assembly, in accordance with the invention.

As can be seen in FIG. 2, the print head 30 includes a retaining structure 44 in which the modules 32 are positioned. Each carrier 34 is in the form of a tile that is mounted in the retaining structure 44. In this example, there are three tiles 34 mounted in the retaining structure 44. Depending on the requirements, there can be more than one retaining structure 44 in the print head 30. The retaining structure 44 has a pair of opposed side portions 46 and a floor portion 48, which define a region 50 in which the tiles 34 are mounted.

The tiles 34 each define nesting formations 56 so that the tiles 34 can nest together in an end-to-end manner along the region 50. Details of the manner in which the tiles 34 are positioned in the region 50 are set out in the above referenced patent applications.

Each tile 34 has a first molding 52 that is positioned on a second molding 54, with both moldings 52, 54 mounted in the region 50 of the retaining structure 44. Structural details of the moldings 52, 54 are provided in the above referenced patent applications. The channel 36 is defined in the first molding 52.

A plurality of raised ribs 58 is defined by the first molding 52 on one side of the channel 36. The raised ribs 58 serve to maintain print media passing over the print head chip 20 at a desired spacing from the print head chip 20. A plurality of conductive strips 60 is defined on an opposed side of the channel 36. The strips 60 are wired to electrical contacts of the chip 20 to connect control circuitry (not shown) to the print head chip 20.

The first molding 52 defines a recess 62 approximately midway along its length. The recess 62 is positioned and dimensioned to engage a catch 64 defined by one of the side portions 46 of the retaining structure 44, when the tile 34 is mounted in the region 50 of the retaining structure 44. Again, details of the manner in which the tiles 34 are mounted in the retaining structure 44 are provided in the above referenced applications.

Figure 3:
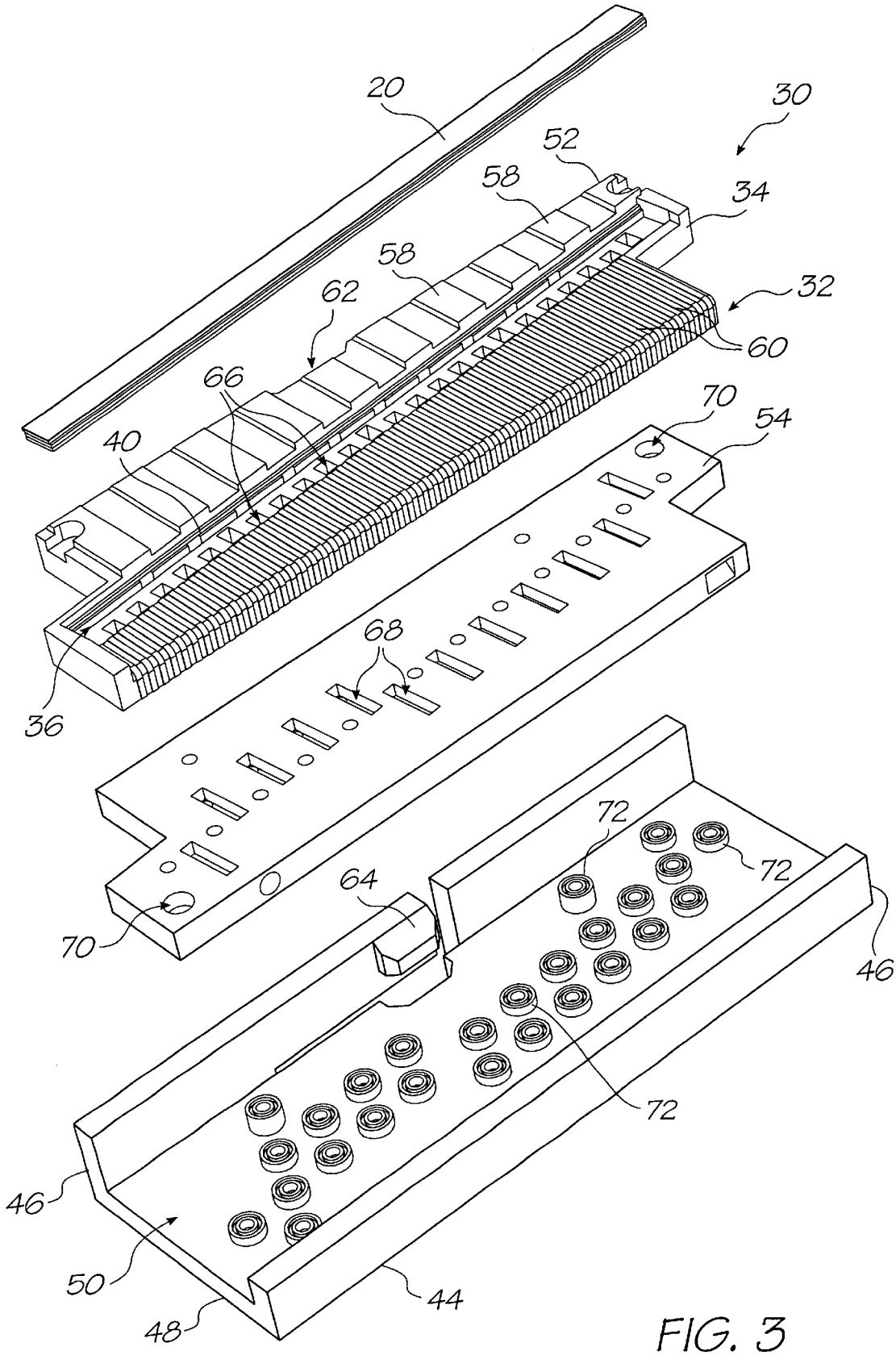
FIG. 3 shows an exploded view of one module of the ink jet print head assembly of FIG. 2.
Figure 4:
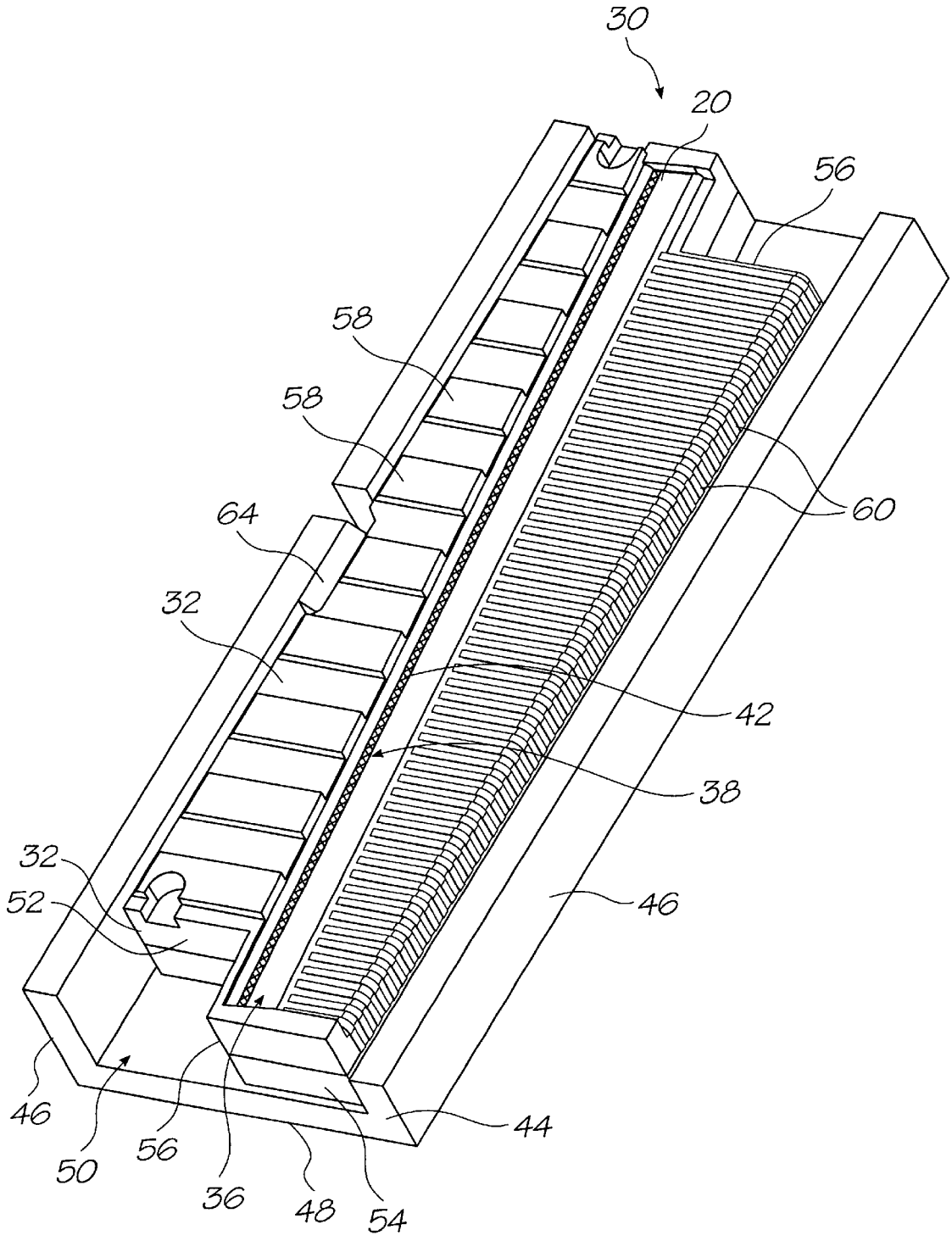
FIG. 4 shows a three dimensional view of the module of FIG. 3.
Figure 5:
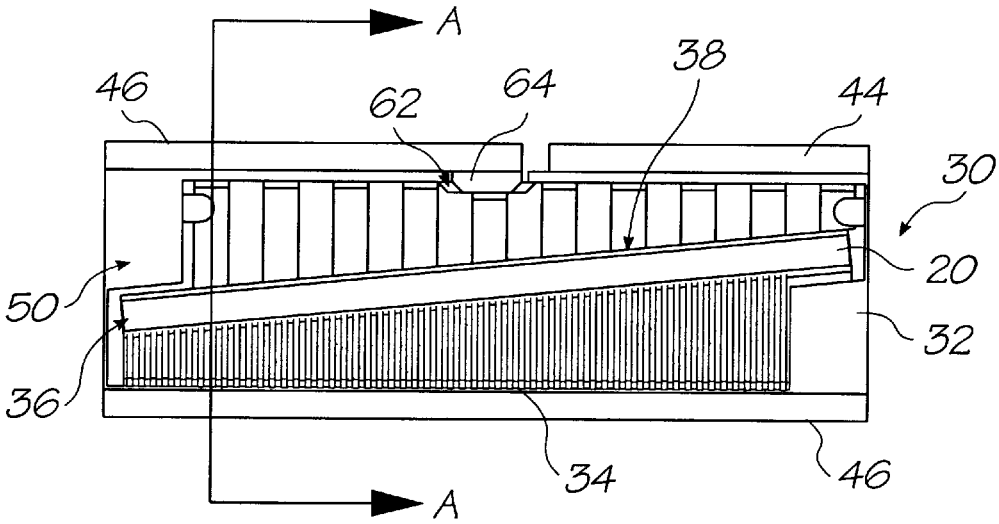
FIG. 5 shows a plan view of the module of FIG. 3.
Figure 6:
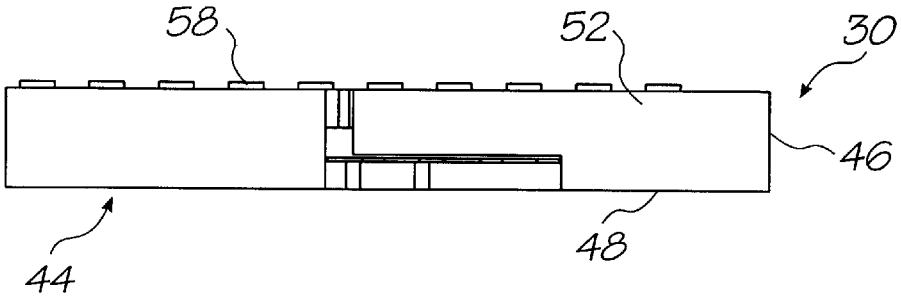
FIG. 6 shows a view from one side of the module of FIG. 3.
Figure 7:
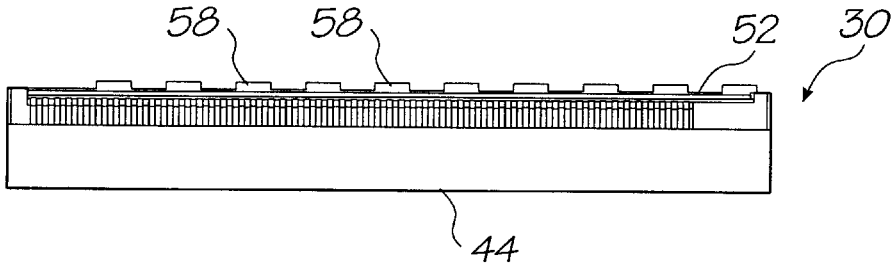
FIG. 7 shows a view from an opposite side of the module of FIG. 3.

As can be seen in FIG. 3, the first molding 52 has a plurality of inlet openings 66 defined therein. The openings 66 are used to supply ink to the print head chip 20.

The openings 66 are in fluid communication with corresponding openings 68 defined at longitudinally spaced intervals in the second molding 54. In addition, openings 70 are defined in the molding 54 for the supply of air. Further details are provided in the above referenced applications.

The tiles 34 and the retaining structure 44 are configured so that a certain amount of relative movement between the tiles 34 and the retaining structure 44 can be accommodated. Details of how this is achieved are set out in the above referenced applications. For example, collared structures 72 are positioned on the floor portion 48 of the retaining structure 44. The collared structures 72 are of a resiliently flexible hydrophobic material and engage complementary recesses defined in the second molding 54. Thus, a tight seal is maintained, in spite of such relative movement. The collars 72 circumscribe openings of passages 74 (FIG. 8) defined in the floor portion 48. Again, further details are provided in the above referenced applications.

Details of the manner in which ink and air is supplied to the chip 20 are set out in the above referenced applications and will therefore not be set out here. Briefly, however, the passages 74 are in fluid communication with the openings 68 in the second mounting, which, in turn, are in fluid communication with the openings 66. The passages 74 are divided into six sets that can receive, for example, cyan, yellow, magenta, black and infrared inks and fixative respectively. Other combinations of up to six types of ink can be used. It follows that the chip 20 is a "six color" chip.

Figure 8:
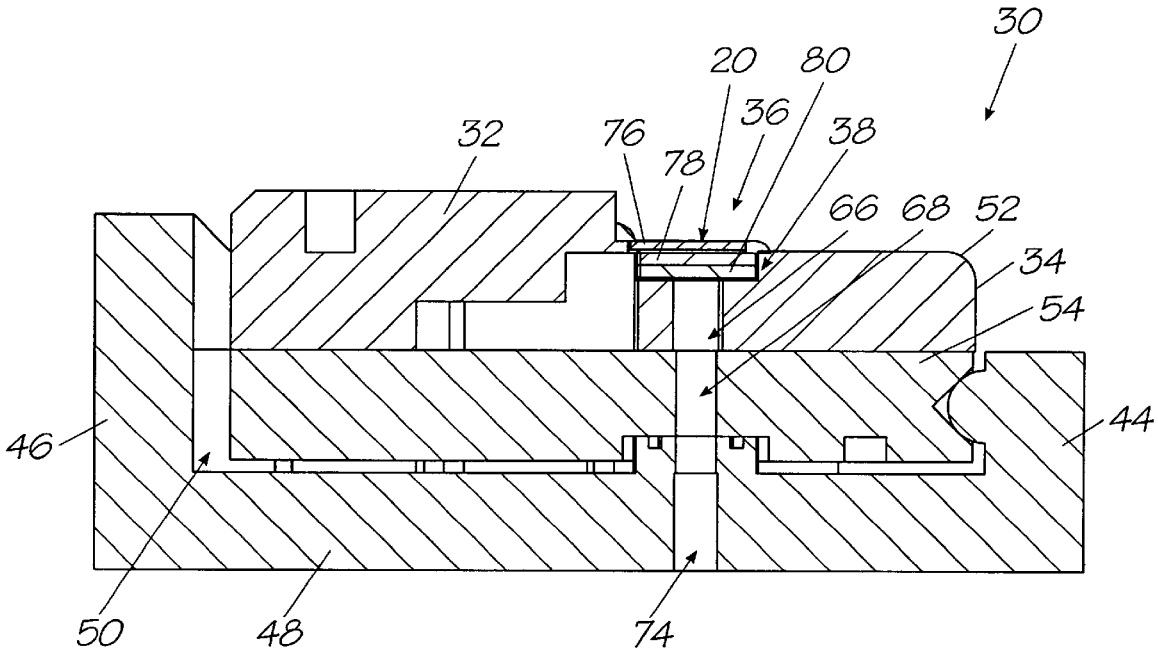
FIG. 8 shows a front sectioned view of the module of FIG. 3, taken through A—A in FIG. 5.

As can be seen in FIG. 8, the print head 30 includes a nozzle guard 76 that covers a nozzle layer 78. The nozzle layer 78 is mounted on a silicon inlet backing 80 as described in greater detail in the above referenced U.S. patent application Ser. No. 09/608,779 now abandoned.

Figure 9:
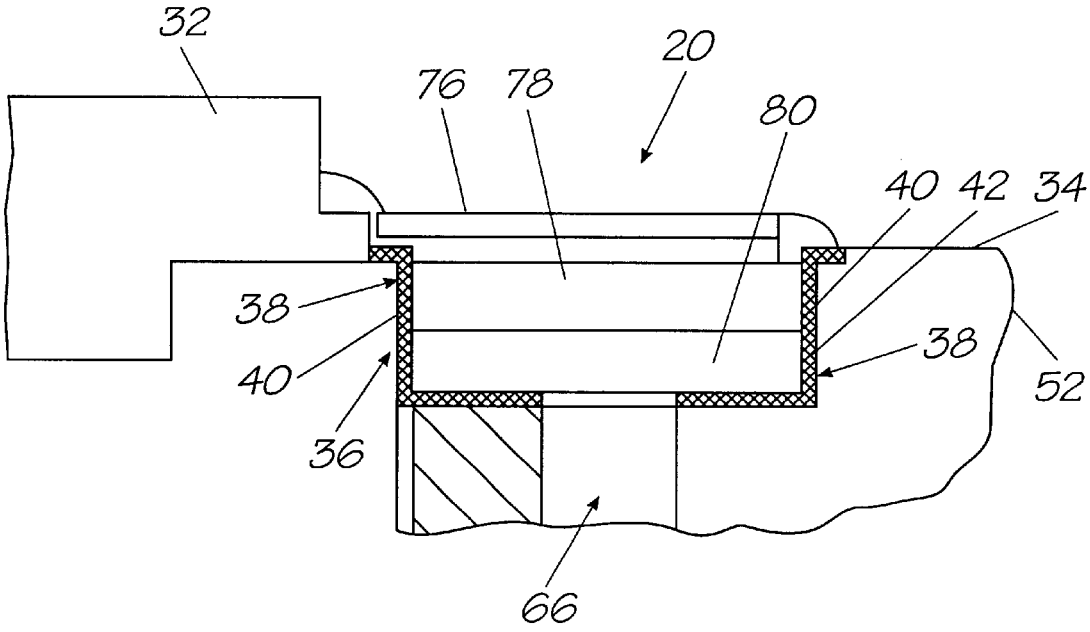
FIG. 9 shows a detailed view of part of the module of FIG. 3.

The gaps 38 and the resiliently flexible material 42 can clearly be seen in FIG. 9.

It will be appreciated by persons skilled in the art that the provision of the gaps 38 together with the resiliently flexible material 42 provides a means whereby a point of stress concentration that may result from the ingress of particulate matter between the chip 20 and the sidewalls 40 of the channels 36 can be avoided. The gaps 38 and the resiliently flexible material 42 obviate the need for press fitting or even snugly fitting the chips 20 in their respective channels 36. Thus, the detrimental effects of the ingress of such particulate matter are alleviated to a substantial extent.

It will further be appreciated by persons skilled in the art that numerous variations and/or modifications may be made to the invention as shown in the specific embodiments without departing from the spirit or scope of the invention as broadly described. The two embodiments are, therefore, to be considered in all respects as illustrative and not restrictive.

We claim:

1. An ink jet print head assembly for a page width ink jet print head, the print head assembly comprising at least one elongate ink jet print head chip that is the product of an integrated circuit fabrication technique;

at least one corresponding ink jet print head chip carrier that defines an elongate recess having a pair of opposed side walls, the, or each, print head chip being received in one respective recess, the, or each, ink jet print head chip and said respective recess being dimensioned so that a gap is defined between the, or each, ink jet print head chip and each side wall; and resiliently deformable material positioned in each gap to fill each gap and to retain the, or each, print head chip in position in said respective recess, the resiliently deformable material being selected to accommodate relative movement of the at least one print head chip and the at least one print head chip carrier during normal handling of the print head assembly.

2. An ink jet print head assembly as claimed in claim 1, which includes a number of the ink jet print head chips positioned in the elongate recesses of the ink jet print head chip carriers that correspond to the ink jet print head chips.

3. An ink jet print head assembly as claimed in claim 1, in which the ink jet print head chip carrier is mounted to an ink distribution manifold.

4. An ink jet print head assembly as claimed in claim 1, which includes a number of modules, each module including one ink jet print head chip carrier and one ink jet print head chip mounted in the carrier and a retaining structure in which the modules are mounted.

5. An ink jet print head assembly as claimed in claim 1, in which the resiliently deformable material is an elastomeric material.

6. An ink jet print head assembly as claimed in claim 5, in which the elastomeric material is in the form of a silicon based material.

7. A method of assembling an ink jet print head having at least one elongate ink jet print head chip that is the product of an integrated circuit fabrication technique and at least one corresponding ink jet print head chip carrier that defines an elongate recess having a pair of opposed side walls, the, or each, ink jet print head chip and said respective recess being dimensioned so that a width of said the, or each, print head chip is less than a width of said respective recess to a predetermined extent, the method comprising the steps of:

positioning the, or each, ink jet print head chip in said respective carrier so that a gap is defined on each side of the ink jet print head chip by said pair of opposed side walls and the ink jet print head chip; and filling each gap with an adhesive that is selected from a group of adhesives that cure into elastically deformable material to fix the, or each, ink jet print head chip in said respective recess, the adhesive being selected so that the elastically deformable material is capable of accommodating relative movement of the, or each, print head chip and the, or each print head chip carrier during normal handling.

* * * * *